US006375522B1

(12) United States Patent
Bellens et al.

(10) Patent No.: US 6,375,522 B1
(45) Date of Patent: Apr. 23, 2002

(54) MOTORIZED NAUTICAL RECREATIONAL VESSEL

(76) Inventors: Marcel Bellens, La Chapelle Auzac, 46200 Souillac; Franck Mauvigner, 3, allée des Bosquets, 94800 Villejuif, both of (FR)

( * ) Notice: Subject to any disclaimer, the term of this patent is extended or adjusted under 35 U.S.C. 154(b) by 0 days.

(21) Appl. No.: 09/442,732

(22) Filed: Oct. 22, 1999

Related U.S. Application Data

(63) Continuation of application No. PCT/FR98/00869, filed on Apr. 29, 1998.

(30) Foreign Application Priority Data

Apr. 30, 1997 (FR) ..... 97 05421

(51) Int. Cl.[7] ..... B63H 11/107

(52) U.S. Cl. ..... 440/40; 114/151; 114/343; 74/469

(58) Field of Search ..... 440/38, 40, 39; 338/128; 74/469, 471 R; 114/343, 151, 345, 61; D23/411

(56) References Cited

U.S. PATENT DOCUMENTS

| | | | | |
|---|---|---|---|---|
| 3,146,587 A | | 9/1964 | Then | |
| 3,391,669 A | | 7/1968 | Buster | |
| 4,044,704 A | | 8/1977 | Miller | |
| 4,138,963 A | | 2/1979 | Thompson | 114/151 |
| 4,239,013 A | | 12/1980 | Haynes | |
| 4,375,631 A | * | 3/1983 | Goldberg | 338/128 |
| 4,437,841 A | * | 3/1984 | Stallman | 440/38 |
| 4,459,117 A | | 7/1984 | Jordan | 440/38 |
| 4,520,746 A | * | 6/1985 | Walters et al. | 114/69 |
| 4,587,917 A | * | 5/1986 | Cantin | 114/61 |
| 4,792,282 A | | 12/1988 | Jordan | |
| 4,925,408 A | * | 5/1990 | Webb et al. | 440/38 |
| 4,942,838 A | * | 7/1990 | Boyer et al. | 440/38 |
| 4,964,821 A | * | 10/1990 | Tafoya | 440/38 |
| 4,994,669 A | * | 2/1991 | Stern | 250/229 |
| 4,997,398 A | * | 3/1991 | Glen | 440/88 |
| 5,081,947 A | | 1/1992 | Holden | 114/345 |
| 5,131,348 A | | 7/1992 | Roy | |
| 5,184,564 A | * | 2/1993 | Robbins et al. | 440/38 |
| 5,282,437 A | | 2/1994 | Avillez de Basto | |
| 5,289,793 A | * | 3/1994 | Aker | 440/38 |
| 5,310,368 A | * | 5/1994 | Kamitake | 440/38 |
| 5,331,914 A | * | 7/1994 | Salmons | 114/346 |
| 5,362,269 A | * | 11/1994 | Leach | 441/65 |
| 5,366,397 A | * | 11/1994 | Suganuma et al. | 440/39 |
| D355,252 S | * | 2/1995 | Andersen | D23/411 |
| 5,401,198 A | * | 3/1995 | Toyohara et al. | 440/47 |
| 5,490,474 A | * | 2/1996 | Ikeda | 440/38 |
| 5,491,462 A | * | 2/1996 | Cecchi et al. | 338/128 |
| 5,607,049 A | * | 3/1997 | Shioda | 200/557 |
| 5,744,765 A | * | 4/1998 | Yamamoto | 200/6 A |

FOREIGN PATENT DOCUMENTS

| | | |
|---|---|---|
| DE | 40 17 144 A1 | 12/1991 |
| FR | 2 215 348 A | 8/1974 |
| FR | 2 621 293 A | 4/1989 |

* cited by examiner

*Primary Examiner*—S. Joseph Morano
*Assistant Examiner*—Lars A. Olson
(74) *Attorney, Agent, or Firm*—Young & Thompson

(57) ABSTRACT

The invention concerns a water sport machine consisting of a hull equipped with a pump-jet, the hull is rigid and provided with an inflatable envelope. The pump-jet consists of a light duty engine combined with a water sucking propeller located in a suction box opening into the hull bottom, the outlet of the suction box opening into a nozzle with decreasing cross-section and a helical wall.

2 Claims, 6 Drawing Sheets

MOTORIZED NAUTICAL RECREATIONAL VESSEL

This Appln is a cont of PCT/FR98/00869 filed Apr. 29, 1998.

BACKGROUND OF THE INVENTION

1. Field of the Invention

The present invention relates to a motorized nautical recreational vessel. More specifically, the invention relates to beach vessels of the "hydrojet" type.

2. Description of the Related Art

The vessels known in the state of the art are suitable for sport activities by informed users who accept relatively high utilization costs.

They are not suitable for use in the form of beach vessels available on a rental basis. Such vessels must fulfill very specific requirements. Such vessels must be of very strong construction so as to provide failure-free reliability. They are used for many hours per day by users who are not especially careful. Upkeep and maintenance must be as low as possible. Operating costs must also be low and the range must be high. This solution could be attained with a sub-motor but such vessels would not be attractive.

SUMMARY OF THE INVENTION

The object of the present invention is to resolve these drawbacks and to fulfill the various requirements by proposing a nautical recreational vessel constituted of a hull equipped with a low-power, hydrojet-type motor.

Typically, for a vessel with an overall length on the order of 2.50 m and an overall width of 2.05 m, the power of the motor is less than 5 KW, e.g., 4 KW.

The carrying capacity allows carrying 3 persons for category 6 navigation.

Advantageously, the hull has a peripheral rim to receive an inflatable annular envelope. According to a specific variant, the inflatable annular envelope has a cut-out in its rear part to allow passage of a rigid segment comprising the directional nozzle.

The overall width is preferably larger than 0.8 times the overall length.

The rigid segment preferably is extended by a mast supporting a sun shade. According to another variant, the motor is constituted by a low-power motor combined with a water suction propeller placed in a suction box emptying into the bottom of the hull, with the outlet of the suction box emptying into a nozzle with a tapering section and a helicoidal wall.

Advantageously, the propeller has three blades in the form of helicoidal ramps extending an essentially cylindrical hub.

According to a preferred mode of implementation, the nozzle has in the large section zone a water inlet for cooling the motor.

Better understanding of the invention can be acquired by reading the description below which refers to a nonlimitative example of implementation, illustrated by the attached drawings in which.

DETAILED DESCRIPTION

Figure 1:
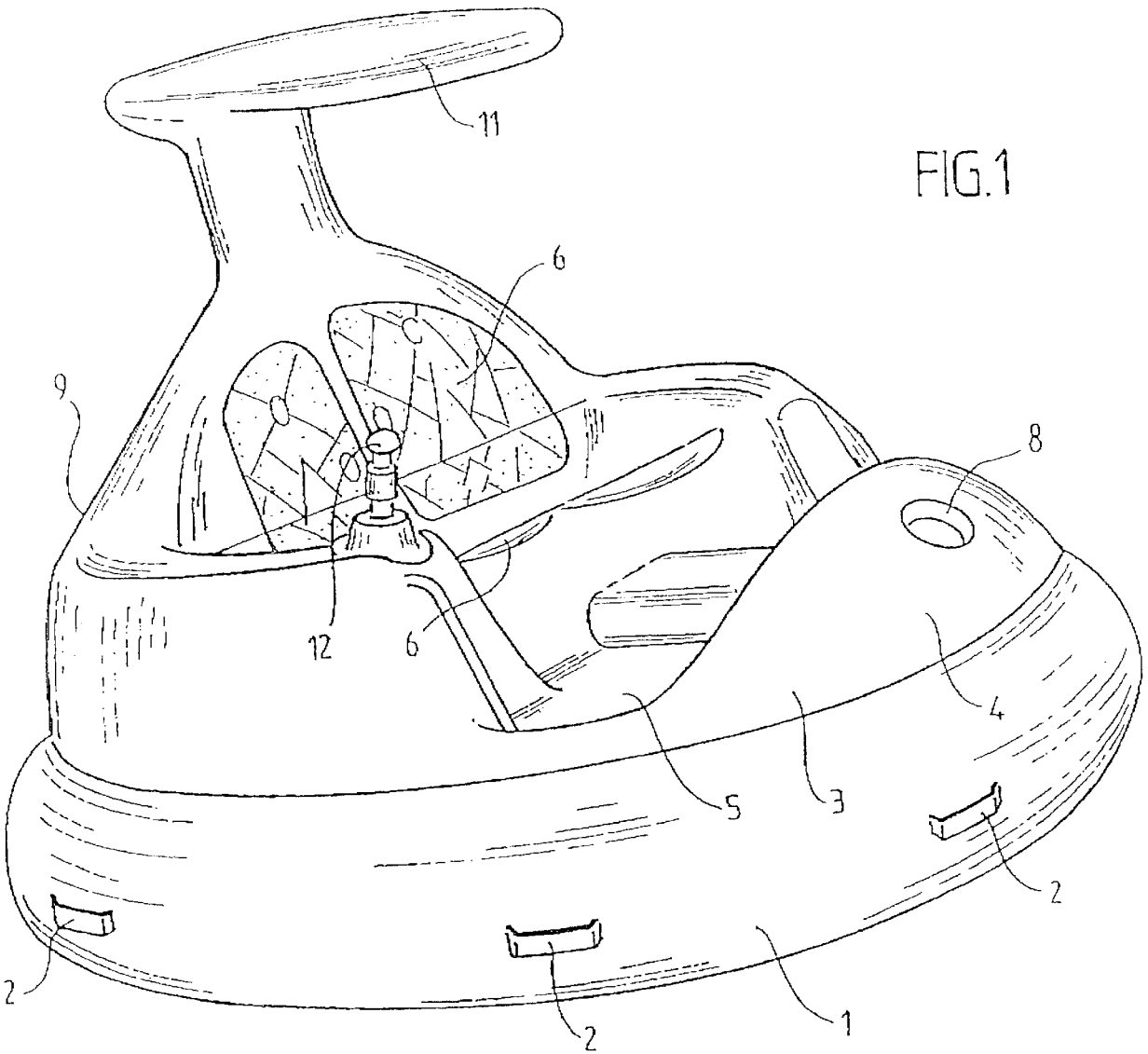
FIG. 1 shows a front view of the vessel according to the invention.

FIG. 1 shows a front view of the vessel according to an example of implementation of the invention. This vessel is constituted by a sheet steel or molded plastic frame presenting a peripheral rim on which is mounted an annular buoyancy reserve (1). This inflatable buoyancy reserve is divided into several compartments for safety reasons. It has handling straps (2) to facilitate portage of the vessel. Mounted on top of the frame is a rigid molded plastic hull (3). It has a hemispherical front part (4) equipped with an access opening (8) for filling the fuel tank. The central part is depressed in the form of a foot rest. It also has a raised part (6) forming the seats. The rear part (9) forms a box divided into a top compartment to carry accessories or the user's bags, and a bottom compartment containing the motor. On top of the vessel is mounted a sun shade (11). It also has an operating lever (12) to control the direction and operation of the motor.

Figure 2:
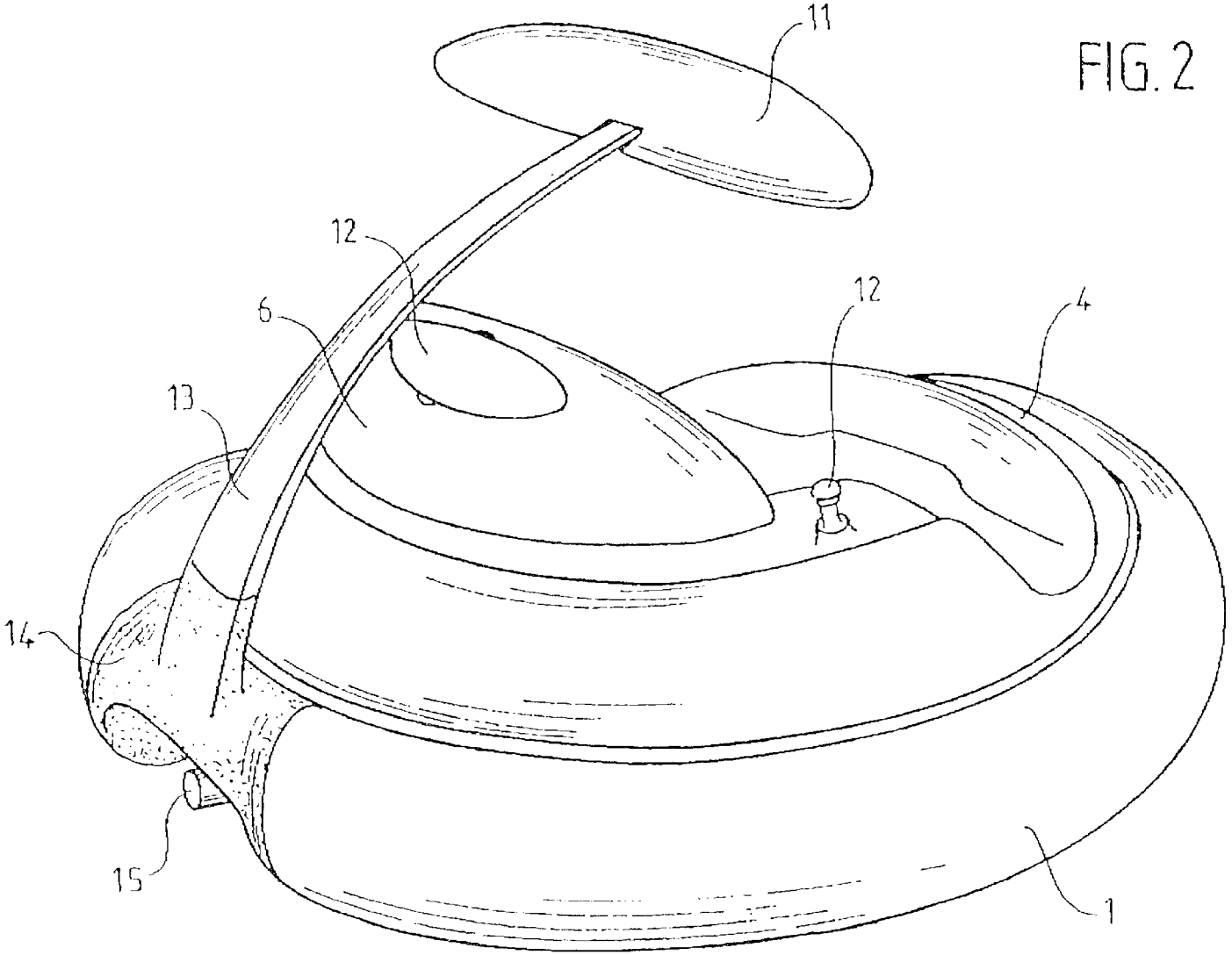
FIG. 2 shows a rear view of the vessel.

FIG. 2 shows a rear view of the vessel. The rear part (9) of the hull has an access opening (7) allowing access to a storage box. In the implementation example described, the sun screen (11) is supported by a mast (13) maintained by a rigid base (14) attached to the frame. The ends of the buoyancy reserve (1) are also attached to this rigid base (14) This base has a cut-out for the directional nozzle (15).

Figure 3:
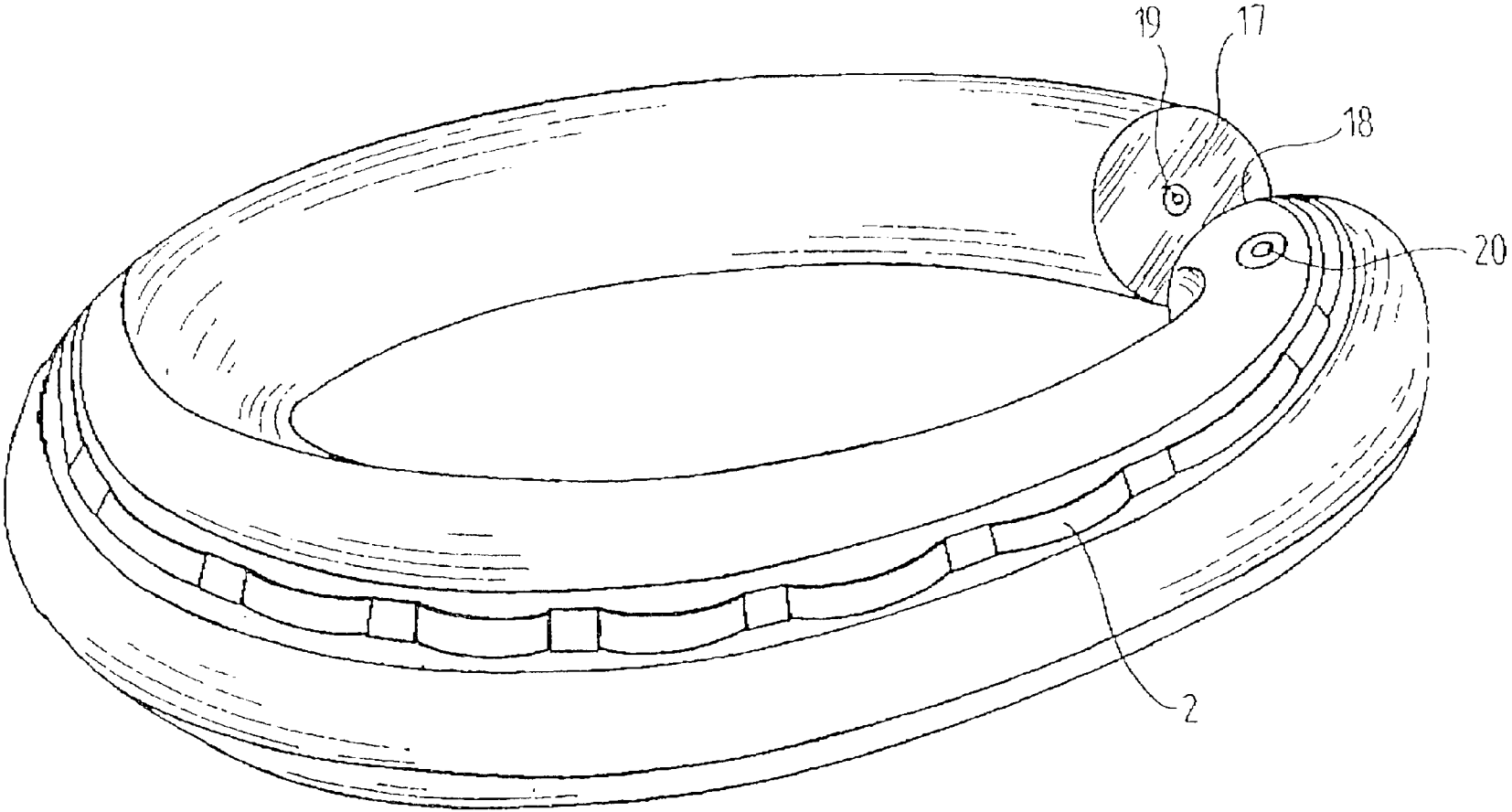
FIG. 3 shows a perspective view of the inflatable envelope.

FIG. 3 shows a detailed view of the buoyancy reserve. It is constituted by an inflatable envelope of annular general shape, the rear part of which has a cut-out (16) of a shape corresponding to the rigid base (14) which fits into this cut-out. The two front surfaces (17, 18) are attached to the base (14) by bolts (19) or any other equivalent means.

Portage straps (2) are attached on the edge of the buoyancy reserve. The various compartments can be inflated via valves (20).

Figure 4:
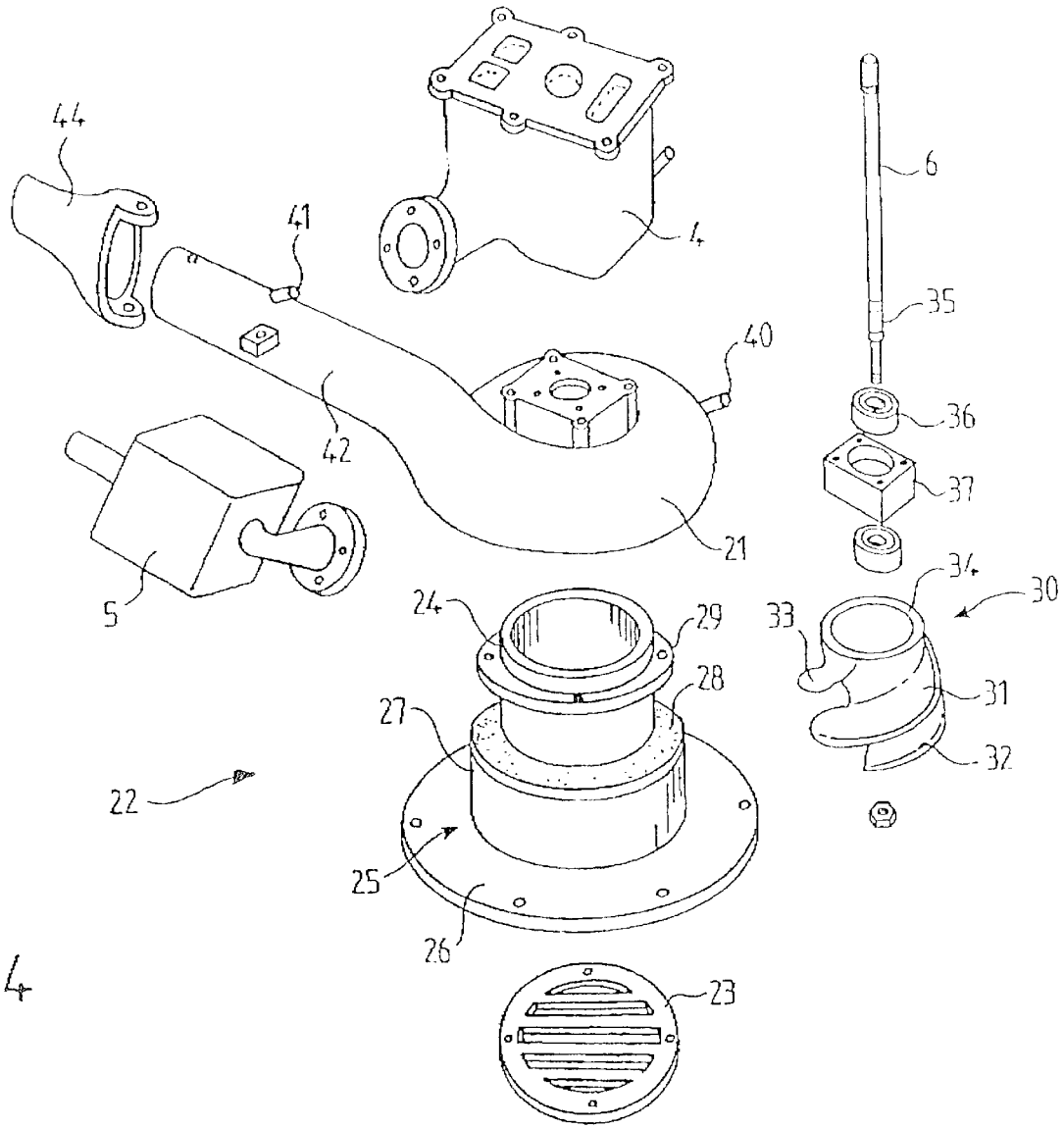
FIG. 4 shows an exploded view of the motor.

FIG. 4 shows an exploded view of the motor group. It comprises, in addition to a heat engine (not shown), a nozzle (21) and a water intake element (22).

The intake element (22) is formed by a cylindrical part mounted on the bottom of the frame by "Silentbloc" bearings or dampening elements that can reduce noise and the transmission of vibrations. In the example shown, the intake element is composed of a tubular interior part (24) and a base (25) with an attachment disk (26) on the bottom of the frame extended by a tubular part (27). The connection between the interior tubular part (24) on which is mounted the nozzle (21) and the exterior part (25) is implemented by an elastic gasket (28) assuring the functions of attachment, limitation of the transmission of vibrations and tightness.

The intake element (22) opens onto the bottom of the frame, in a direction that is essentially perpendicular to the bottom of the frame, via a protective grating (23). The other end of the intake element (22) has a collar (29) for attachment onto the nozzle (21).

Inside the intake element (22) is located a propeller (30), the shape of which is similar to that of a carving knife. It has three helicoidal blades (31 to 33) welded onto a hub (34) of cylindrical shape that is preferably conical, spreading in the upstream direction. A connecting pin (35) assures the connection with the heat engine. This connecting pin passes through a guide (37) attached to the nozzle and is maintained by ball bearings (36). The nozzle has a frontal inlet, oriented downwards, and a radial outlet, oriented rearwards, perpendicular to the intake direction. It has a tapering interior section and a helicoidal wall driving an acceleration of the water jet. A lateral outlet (40) located in the zone of thickest section, oriented in an approximately radial direction, provides for circulation of the cooling water of the heat engine. Another outlet (41) located on the ejection pipe (42) provides for aspiration of the water that might collect at the bottom of the frame.

A directional nozzle (44) articulated on the end of the ejection pipe (42) provides for orientation of the jet in the horizontal plane. This directional nozzle (44) is controlled by the sleeve (12). The connection is provided by a single cable.

Figure 5:
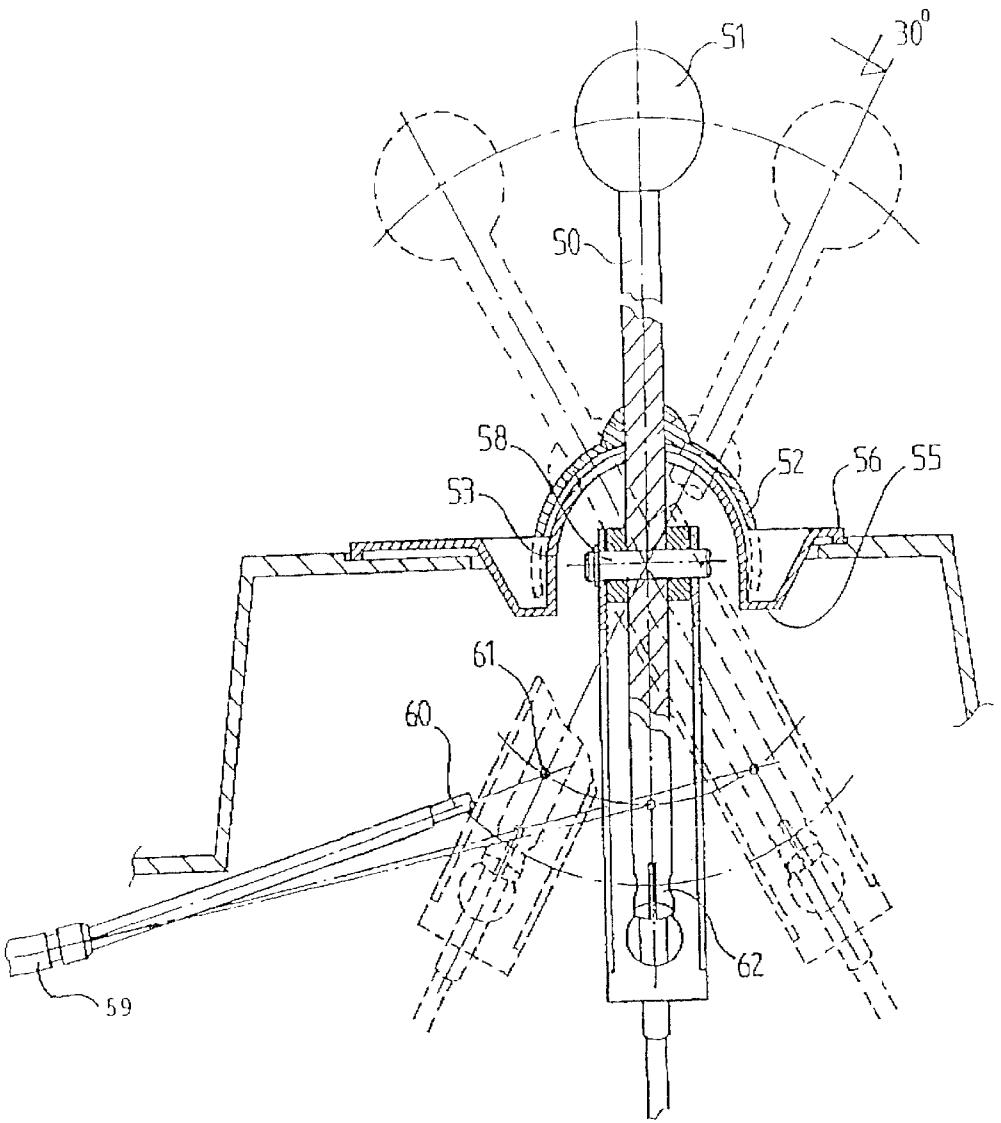
FIG. 5 shows a detailed view of the control lever.

FIG. 5 shows a detailed view of the control lever (12). The control is constituted by a rod (50) equipped at its end with a control ball (51). The rod (50) is articulated around two perpendicular axes.

The first axis is defined by a hemispherical dome (52) that is mobile in relation to a hemispherical base (53). This base has an annular channel (55) for collecting drops of water and dust. This channel opens onto the exterior surface of the hull via an evacuation slot. The base is extended by an attachment plate (56) for mounting via a circular hole provided on the hull for that purpose.

The second axis is constituted by a pivot (58). The end (60) of a cable is attached on the bottom part (61) of the shaft. The cable has a sheath checked by a stop (59). This cable is linked to the control arm of the heat engine's accelerator.

In the perpendicular direction, the shaft has a second fastening point (62) of a control means for the directional nozzle.

Figure 6:
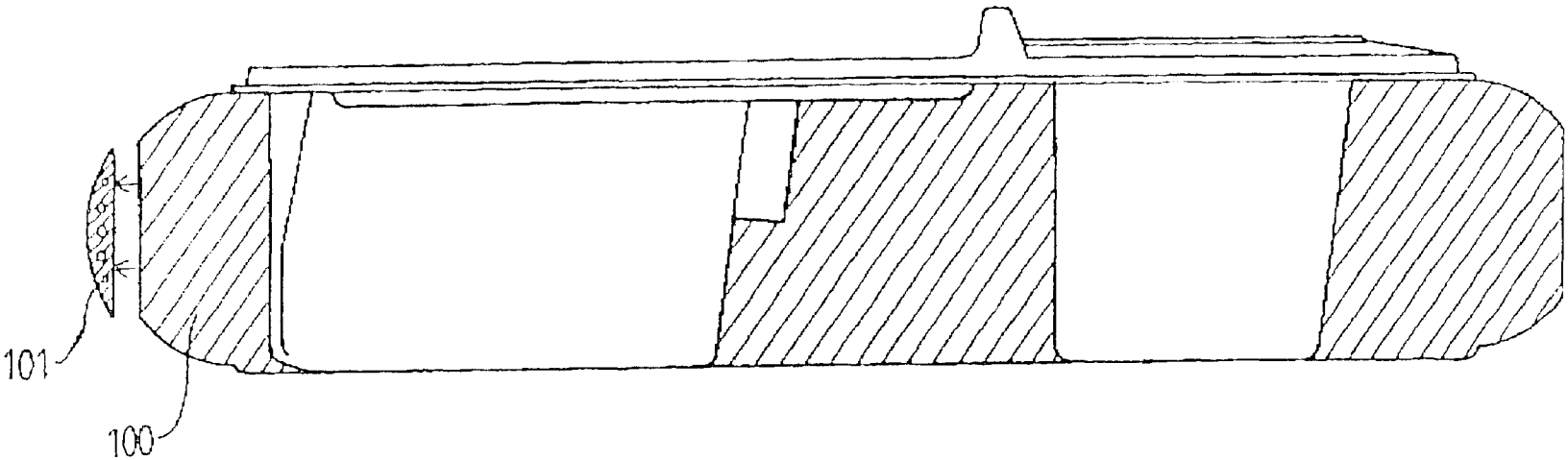
FIG. 6 shows a sectional view of a variant of implementation of the hull.

FIG. 6 shows a sectional view of a variant of implementation of the hull.

According to this variant, the hull is implemented in the form of a rigid structure, for example molded from a material such as PVC.

The hull is molded in two parts: a bottom part which comprises the entire buoyant part, and a top part forming a cover comprising the visible parts. The junction line is designed to be above the waterline. The hull has an approximately circular section.

The two parts are joined along a belt line by gluing. The top part forms a cover that has housings for parts such as the motor or the batteries.

This hull has an annular external caisson (100) on which is glued a honey-comb ring (101) forming a shock absorber. This ring has a section in the shape of an arc of a circle, and has longitudinal channels that endow it with elasticity. This ring (101) is made by extrusion of a material such as PVC.

The invention has been described above as a nonlimitative example. It is obvious that an expert in the art could implement variants of implementation without, however, going beyond the scope of the invention.

What is claimed is:

1. A nautical recreational vessel, comprising a rigid hull having a bottom, propulsion means carried by the hull to propel the hull through the water, means for controlling the direction of movement of the hull through the water, said control means including a control lever, and means mounting the control lever on the vessel for universal movement relative to the vessel, said mounting means comprising a pair of part-spherical domes that overlie each other and are in slidable contact with each other, the upper of said domes being secured to said control lever for movement with said control lever.

2. A nautical recreational vessel as claimed in claim 1, said control lever having a pivotal axis intermediate its length, said axis being perpendicular to said control lever and lying on the center of curvature of said part-spherical domes.

* * * * *